US010246901B2

(12) United States Patent
Edwards et al.

(10) Patent No.: US 10,246,901 B2
(45) Date of Patent: Apr. 2, 2019

(54) LOCK ASSEMBLY WITH REMOVABLE COVER

(71) Applicant: GM GLOBAL TECHNOLOGY OPERATIONS LLC, Detroit, MI (US)

(72) Inventors: Robert J. Edwards, Lapeer, MI (US); Richard J. Lange, Troy, MI (US)

( * ) Notice: Subject to any disclaimer, the term of this patent is extended or adjusted under 35 U.S.C. 154(b) by 137 days.

(21) Appl. No.: 15/462,093

(22) Filed: Mar. 17, 2017

(65) Prior Publication Data

US 2018/0266143 A1 Sep. 20, 2018

(51) Int. Cl.

| | |
|---|---|
| ***E05B 17/14*** | (2006.01) |
| ***E05B 81/90*** | (2014.01) |
| *E05B 35/00* | (2006.01) |
| *E05B 85/10* | (2014.01) |

(52) U.S. Cl.

CPC ..... *E05B 17/142* (2013.01); *E05B 81/90* (2013.01); *E05B 35/008* (2013.01); *E05B 85/10* (2013.01)

(58) Field of Classification Search

CPC ..... E05B 17/14; E05B 17/142; E05B 17/18
See application file for complete search history.

(56) References Cited

U.S. PATENT DOCUMENTS

| | | | | |
|---|---|---|---|---|
| 9,260,892 | B2 * | 2/2016 | Lennhoff | E05B 85/06 |
| 9,708,831 | B2 * | 7/2017 | Mathofer | E05B 17/183 |
| 2010/0162777 | A1 * | 7/2010 | Savant | E05B 17/186 70/101 |
| 2015/0114060 | A1 * | 4/2015 | Rosenau | E05B 77/34 70/431 |
| 2018/0195319 | A1 * | 7/2018 | Cousin | E05B 81/76 |

* cited by examiner

*Primary Examiner* — Catherine A Kelly

(57) ABSTRACT

A vehicle assembly includes a door and a lock. The lock is configured to selectively maintain the door in a closed position. The lock has a receptor arranged on an exterior side of the door. The vehicle assembly additionally includes a physical engagement interface disposed proximate the receptor. The vehicle assembly also includes a cover which is removably coupled to the physical engagement interface. The cover has an interior surface, an exterior surface, and an aperture extending from the exterior surface through the interior surface. When coupled to the engagement interface, the cover inhibits access to the receptor. The vehicle assembly further includes a deflectable retaining member. The deflectable retaining member is configured to deflect from a first position, retaining the cover to the engagement interface, to a second position, releasing the cover from the engagement interface, in response to insertion of a tool into the aperture.

11 Claims, 4 Drawing Sheets

LOCK ASSEMBLY WITH REMOVABLE COVER

TECHNICAL FIELD

The present disclosure relates to motor vehicles. More particularly, the present disclosure relates to such vehicles having remotely-activatable key mechanisms, e.g. electric locks for vehicle doors.

INTRODUCTION

Automotive vehicles may be provided a variety of remotely-activated features, e.g. activatable via a key fob and/or a mobile device. Examples of such features include electric door locks and vehicle ignition. Such features may be provided with a conventional, e.g. key-actuated, backup mechanism. A user may thus gain access to the vehicle and its features when the remote functions are unavailable, as may occur when a battery in the key fob or in the vehicle has insufficient charge to perform the remotely-activated feature.

SUMMARY

A vehicle assembly according to the present disclosure includes a door with an interior side and an exterior side, a latch, and a lock. The latch has a disengaged position in which the door may be opened and an engaged position in which the door is inhibited from being opened. The lock is configured to selectively maintain the latch in the engaged position. The lock has a receptor arranged on the exterior side. The vehicle assembly additionally includes a physical engagement interface disposed on the exterior side proximate the receptor. The vehicle assembly also includes a cover which is removably coupled to the physical engagement interface. The cover has an interior surface, an exterior surface, and an aperture extending from the exterior surface through the interior surface. When coupled to the engagement interface, the cover inhibits access to the receptor. The vehicle assembly further includes a deflectable retaining member with a first position and a second position. In the first position the retaining member retains the cover to the engagement interface and in the second position the retaining member does not retain the cover to the engagement interface. The deflectable retaining member is configured to deflect from the first position to the second position in response to insertion of a tool into the aperture.

In an exemplary embodiment, the retaining member has a first end and a second end, the first end being coupled to the exterior side and the second end being disposed in register with the aperture. In such embodiments, the retaining member and the engagement interface may form a unitary piece.

In an exemplary embodiment, the vehicle assembly may also include a lift member arranged to, in response to insertion of a tool into the aperture, deflect the cover relative to the engagement interface. In such embodiments, the lift member may be coupled to the interior surface of the cover. A floor member may be coupled to the exterior side and spaced from the lift member to accommodate a tool inserted into the aperture therebetween. The floor member and the engagement interface may form a unitary piece.

In an exemplary embodiment, the engagement interface includes a recess feature and the cover comprises a protrusion feature. The protrusion feature is engageable with the recess feature to couple the cover to the engagement interface.

In an exemplary embodiment, the receptor includes a keyhole having a keyhole height, and the aperture has an aperture height corresponding to the keyhole height.

An assembly according to the present disclosure includes a component with a physical engagement interface, a cover, and a deflectable member. The cover is removably coupled to the physical engagement interface. The cover has an interior surface, an exterior surface, and an aperture extending from the exterior surface through the interior surface. The deflectable retaining member has a first position and a second position. In the first position the retaining member retains the cover to the engagement interface and in the second position the retaining member does not retain the cover to the engagement interface. The deflectable retaining member is configured to deflect from the first position to the second position in response to insertion of a tool into the aperture.

In an exemplary embodiment, the retaining member has a first end and a second end. The first end is coupled to the component and the second end is disposed in register with the aperture. In such an embodiment, the retaining member and the engagement interface may form a unitary piece.

In an exemplary embodiment, the assembly additionally includes a lift member. The lift member is arranged to, in response to insertion of a tool into the aperture, deflect the cover relative to the engagement interface. The lift member may be coupled to the interior surface of the cover. Such an embodiment may additionally include a floor member coupled to the component and spaced from the lift member to accommodate a tool inserted into the aperture therebetween. The floor member and the engagement interface may form a unitary piece.

In an exemplary embodiment, the engagement interface includes a recess feature and the cover includes a protrusion feature. The protrusion feature is engageable with the recess feature to couple the cover to the engagement interface.

In an exemplary embodiment, the assembly additionally includes a keyhole disposed on the component, and the cover is positioned to inhibit access to the keyhole when coupled to the physical engagement interface. The keyhole has an associated keyhole height, and the aperture has an aperture height corresponding to the keyhole height.

An automotive vehicle assembly according to the present disclosure includes a vehicle panel, a physical engagement interface disposed on the panel, and a cover. The cover is removably coupled to the physical engagement interface. The cover has an interior surface, an exterior surface, and an aperture extending from the exterior surface through the interior surface. The assembly additionally includes a lift member, a floor member, and deflectable retaining member. The lift member is coupled to the interior surface and is arranged to, in response to insertion of a tool into the aperture, deflect the cover relative to the engagement interface. The floor member is coupled to the panel and spaced from the lift member to accommodate a tool inserted into the aperture therebetween. The retaining member has a first end and a second end. The first end is coupled to the panel and the second end is disposed in register with the aperture. The retaining member is deflectable between a first position and a second position. In the first position the retaining member retains the cover to the engagement interface and in the second position the retaining member does not retain the cover to the engagement interface. The deflectable retaining member is configured to deflect from the first position to the second position in response to insertion of a tool into the aperture.

In an exemplary embodiment, the vehicle panel includes an exterior body panel having a keyhole disposed thereon. The cover is positioned to inhibit access to the keyhole when coupled to the physical engagement interface.

Embodiments according to the present disclosure provide a number of advantages. For example, a vehicle assembly according to the present disclosure provides a cover for an orifice, such as a keyhole, which may be removed to provide access to the orifice. Moreover, the cover may be easily and intuitively removed without causing unintended wear to the vehicle.

The above advantage and other advantages and features of the present disclosure will be apparent from the following detailed description of the preferred embodiments when taken in connection with the accompanying drawings.

DETAILED DESCRIPTION

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the exemplary aspects of the present disclosure. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
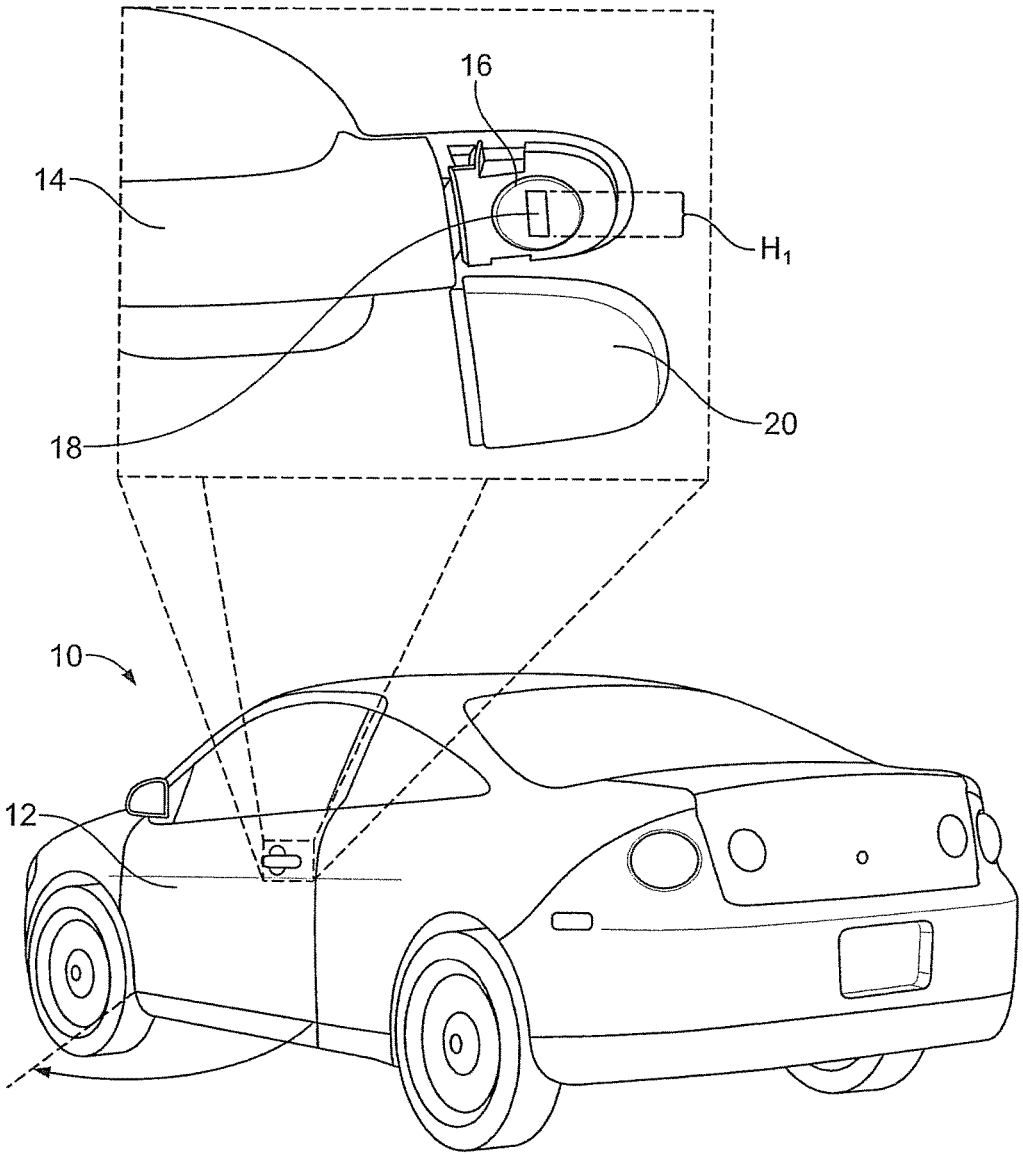
FIG. 1 is a first view of a vehicle assembly according to the present disclosure.

Referring now to FIG. 1, an automotive vehicle 10 according to the present disclosure is illustrated. The vehicle 10 includes a door 12. The door 12 is movable between a closed position, as illustrated in FIG. 1, and an open position, as illustrated by the arrow.

An external actuation unit 14, which may be referred to as a handle, is provided on an exterior of the door 12. An internal actuation unit may also be provided on an interior, i.e. cabin-, side of the door 12. The external actuation unit 14 and any internal actuation unit are coupled to a latch mechanism via a linkage. In response to operator actuation of the external actuation unit 14, the latch mechanism may release and the door 12 may be moved from the closed position to the open position.

A lock mechanism 16 is provided to secure the door 12 in the closed position. The lock mechanism 16 has a locked state and an unlocked state. When in the locked state, the door 12 is maintained in the closed position. When in the unlocked state, the door 12 may be moved to the open position.

The lock mechanism 16 is provided with both primary and secondary systems for moving between the locked and unlocked state. The primary system is an electronically-controlled system, e.g. including one or more electromechanical actuators for shifting between the locked and unlocked state in response to a lock control signal. The lock control signal may be transmitted via, for example, a remote key fob, an application on a mobile device, or other appropriate means.

The secondary system is a mechanically-controlled system, which may be used in situations when the primary system is unavailable. Such situations include, for example, when a vehicle battery state of charge is inadequate to support the primary system, or when a key fob or mobile device battery state of charge is inadequate to transmit a lock control signal.

The lock mechanism 16 is provided with a receptor 18, which may alternatively be referred to as a keyhole, for receiving a key or similar tool to mechanically move the lock mechanism 16 between locked and unlocked states. The receptor 18 has a height $H_1$, which is sized to accommodate the key or tool to be received therein.

A removable cover 20 is provided to cover the receptor 18. When installed, the cover 20 is generally flush with the handle 14. This arrangement enhances the aesthetic appeal of the configuration, increasing customer satisfaction. The cover 20 is provided with an aperture on a lower surface, not visible in this view but discussed in further detail below.

Figure 2:
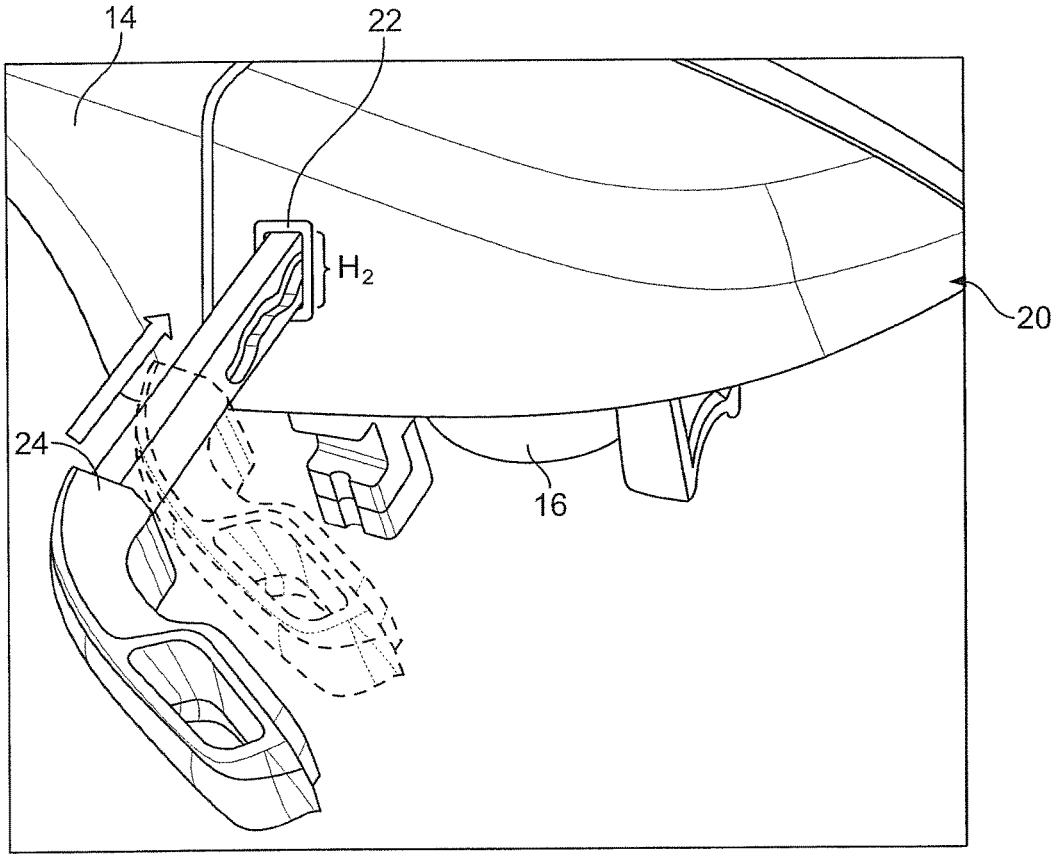
FIG. 2 is a second view of a vehicle assembly according to the present disclosure.

Referring now to FIG. 2, a bottom view of the cover 20 is illustrated. The cover 20 is secured to the vehicle via a physical engagement interface, as will be discussed in further detail below with respect to FIG. 3.

The cover 20 includes an aperture 22 extending from the outer surface of the cover 20 through the inner surface of the cover 20. The aperture 22 has a height $H_2$. In a preferred embodiment, the height $H_2$ is generally the same as the height $H_1$ of the receptor, i.e. sized to accommodate a key or tool. To remove the cover 20, a tool 24, which in this embodiment takes the form of a conventional key, may be inserted into the aperture 22 as shown by the arrow. In this embodiment, the height $H_2$ is only slightly larger than that of the tool 24. This configuration makes it clear to an operator that the tool 24 should be inserted directly into the aperture 22, deterring prying or twisting of the tool 24 which could cause unintended wear or other detriment to the cover 20. Insertion of the tool 24 into the aperture 22 engages various features to detach the cover 20 from the engagement interface and in turn from the vehicle, as will be discussed in further detail below.

Figure 3:
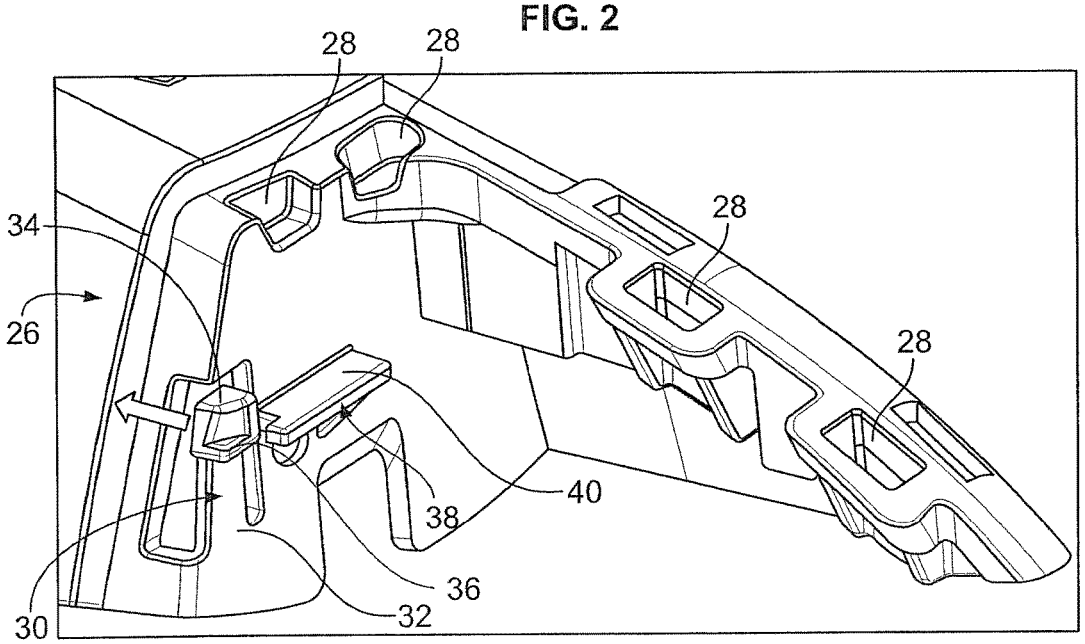
FIG. 3 is a third view of a retention member according to the present disclosure.

Referring now to FIG. 3, a physical engagement interface 26 is illustrated. The physical engagement interface 26 is coupled to the exterior of the vehicle door in the vicinity of the receptor. The physical engagement interface 26 is provided with multiple features to cooperate with the cover.

A plurality of recess features 28 are provided about a perimeter of the engagement interface 26. The recess features 28 are configured to engage with corresponding protruding features on the cover to locate the cover in the desired position. The engagement of recess features 28 with protruding features of the cover may also retain the cover in place, e.g. by friction or by the addition of clip devices within the recess features 28.

The engagement interface 26 is also provided with a resiliently-deflectable retaining member 30. The retaining member 30 has a first end 32 which is coupled to the door, e.g. via another portion of the engagement interface 26, and a second end 34 which is spaced from the first end 32. The second end 34 is positioned such that when the cover is engaged with the engagement interface 26, the second end 34 is in register with the aperture 22. The second end 34 has an angled profile, such that in response to insertion of a tool into the aperture 22, the second end 34 is displaced laterally as illustrated by the arrow. The retaining member 30 is formed of a resilient material, such that the retaining member 30 may return to an initial position upon removal of a tool from the aperture 22.

The second end is also provided with an initial guide surface 36. The initial guide surface 36 is provided in register with the aperture 22 and is configured to direct a tool toward a secondary guide surface discussed below.

The engagement interface 26 is further provided with a ramp feature 38 having a secondary guide surface 40. The ramp feature 38 is located such that when the cover is engaged with the engagement interface 26, the ramp feature 38 is below the aperture when viewed from the orientation of FIG. 3, with the guide surface 40 positioned to support a tool inserted into the aperture.

In the exemplary embodiment of FIG. 3, the physical engagement interface 26 is formed as a unitary piece, e.g. molded from a plastic material. However, in other considered embodiments, the engagement interface 26 is formed of multiple distinct components.

In the exemplary embodiment of FIG. 3, the physical engagement interface 26 is positioned aft of, and abutting, a door handle assembly. However, in other considered embodiments, the engagement interface 26 may be positioned in other locations on the vehicle.

Figure 4:
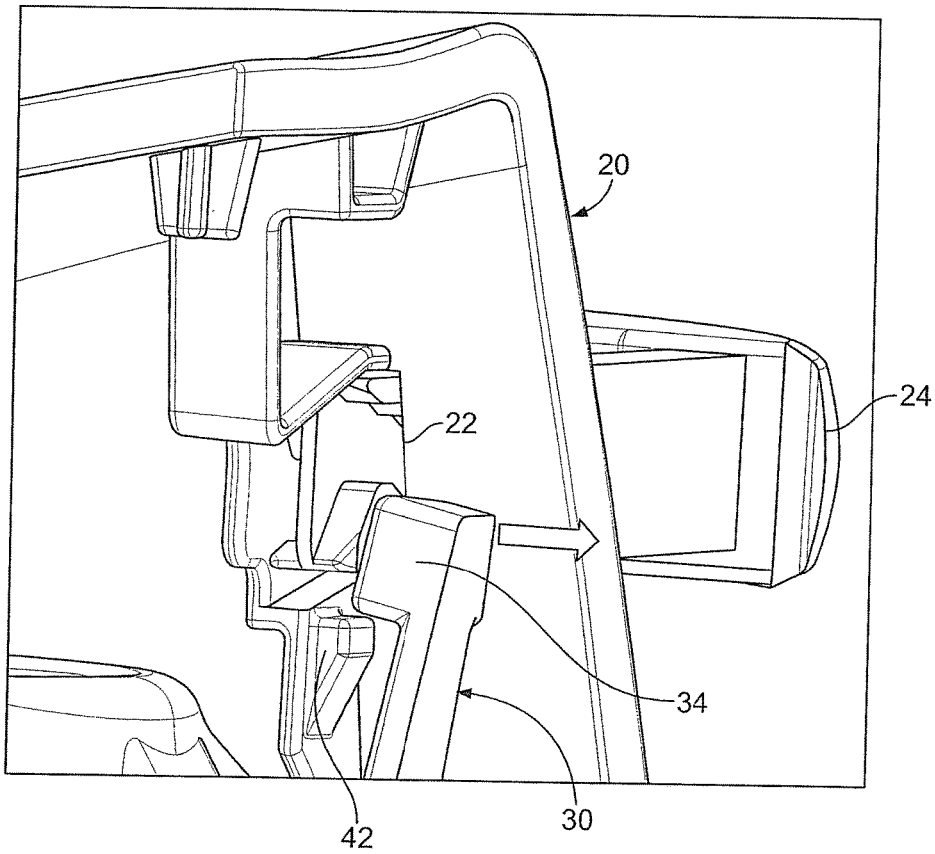
FIG. 4 is a fourth view of a vehicle assembly according to the present disclosure.
Figure 5:
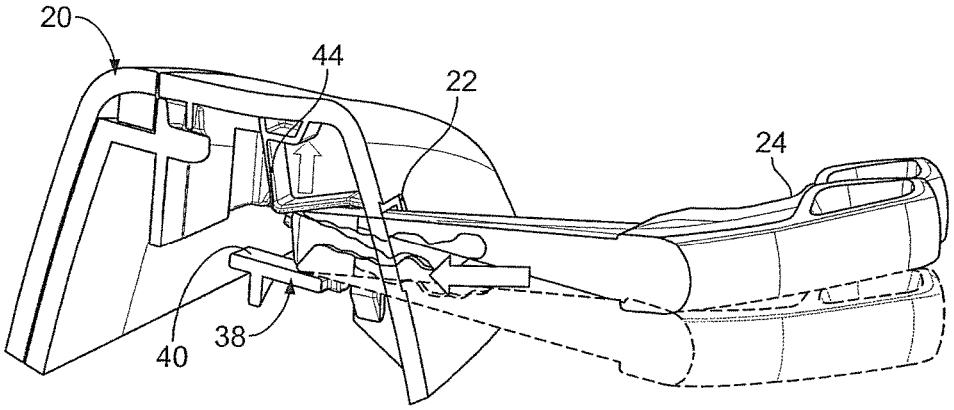
FIG. 5 is a fifth view of a vehicle assembly according to the present disclosure.

Referring now to FIGS. 4 and 5, cutaway views of the interior of the cover 20 during insertion of the tool 24 are illustrated. As the tool 24 is inserted through the aperture 22, the tool 24 displaces the second end 34 of the retaining member 30 in a lateral direction, as illustrated by the arrow. The second end 34 is thus disengaged from a flange 42 which is coupled to the interior of the cover 20, releasing the cover 20 for removal from the engagement interface 26.

In addition, the guide surface 40 of the ramp feature 38 supports and guides the tool 24 in a generally upward direction when viewed from the orientation of FIG. 5. The tool 24 is guided into contact with a lift member 44. The lift member 44 is disposed on an interior surface of the cover 20 and is configured to, in response to an insertion force applied to the tool 24, apply a lifting force to the cover 20 to detach the cover 20 from the engagement interface 26, as illustrated by the arrow. The cover 20 may then be easily lifted from the engagement interface 26 while remaining captive on the tool 24, as illustrated in FIG. 6.

Figure 6:
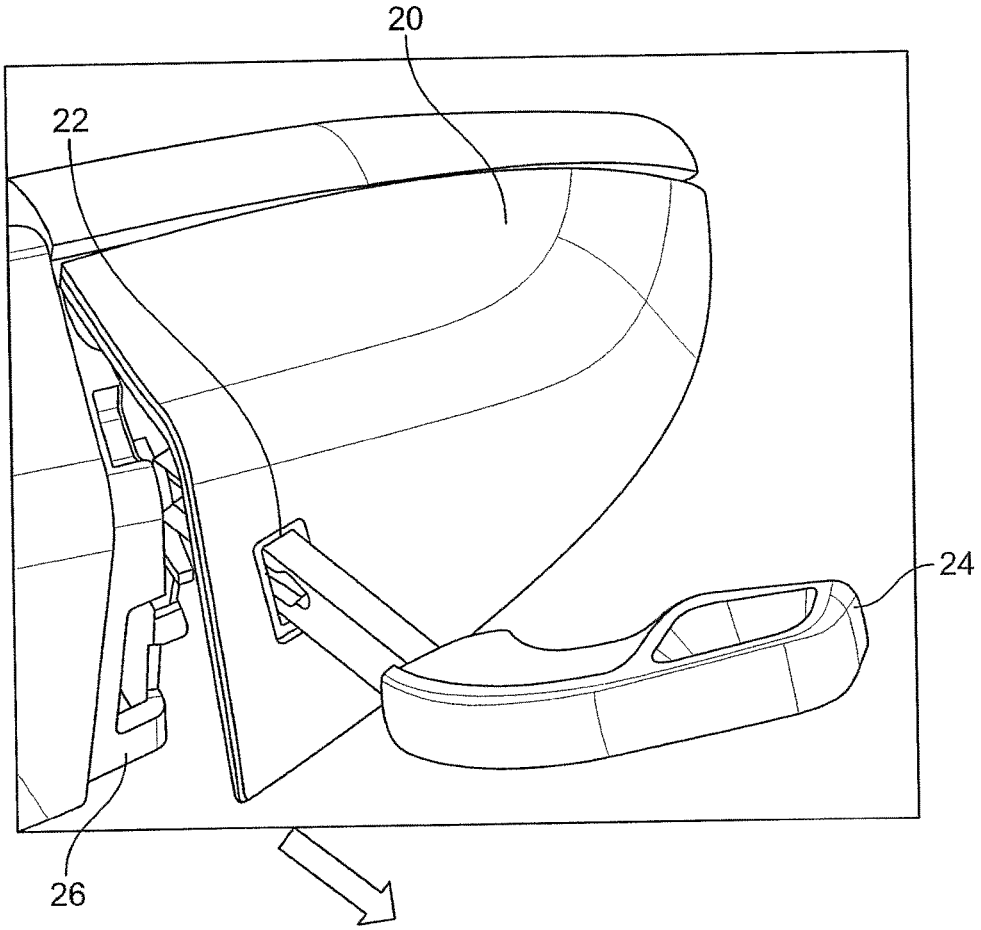
FIG. 6 is a sixth view of a vehicle assembly according to the present disclosure.

In the exemplary embodiment of FIGS. 4-6, the cover 20 is formed as a unitary piece, e.g. molded from a plastic material. However, in other considered embodiments, the cover 20 is formed of multiple distinct components.

As may be seen, the assembly of FIGS. 1-6 therefore enables a single user action, namely insertion of the tool 24 into the aperture 22, to decouple the cover 20 from the engagement interface 26 and, in a continuous motion, lift the cover 20 away from the interface 26.

While the exemplary embodiment of FIGS. 1-6 is directed to a key cylinder for a vehicle door, one of ordinary skill in the art would appreciate that other embodiments may be used to provide a removable cover for covering other types of apertures in other locations on an automotive vehicle, such as a fuel port or electric panel. Likewise, other embodiments may be implemented in a variety of non-automotive applications.

Thus, the present disclosure provides an assembly for covering an orifice such as a keyhole. The assembly includes a cover which may be removed to provide access to the orifice. Moreover, the cover may be easily and intuitively removed without causing unintended wear to the vehicle. The cover may also have increased durability relative to known designs.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further exemplary aspects of the present disclosure that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and can be desirable for particular applications.

What is claimed is:

1. A vehicle assembly comprising:

a door having an interior side and an exterior side, the door being movable between an open position and a closed position;

a lock configured to selectively inhibit the door from moving from the closed position to the open position, the lock having a receptor arranged on the exterior side;

a physical engagement interface disposed on the exterior side proximate the receptor;

an engagement member;

a cover, removably coupled to the physical engagement interface, the cover having an interior surface, an exterior surface, and an aperture extending from the exterior surface through the interior surface, wherein when coupled to the engagement interface the cover inhibits access to the receptor;

a deflectable retaining member having a first position and a second position, wherein in the first position the retaining member engages with the engagement member to retain the cover to the engagement interface and in the second position the retaining member does not engage with the engagement member, and wherein the deflectable retaining member is configured to deflect from the first position to the second position in response to insertion of a tool into the aperture; and a lift member arranged on the cover and configured to, in response to insertion of the tool into the aperture, deflect the cover relative to the engagement interface.

2. The vehicle assembly of claim 1, wherein the retaining member has a first end and a second end, the first end being coupled to the exterior side and the second end being disposed in register with the aperture.

3. The vehicle assembly of claim 2, wherein the retaining member and the engagement interface form a unitary piece.

4. The vehicle assembly of claim 1, wherein the lift member is coupled to the interior surface of the cover.

5. The vehicle assembly of claim 1, further comprising a floor member coupled to the exterior side and spaced from the lift member to accommodate the tool inserted into the aperture therebetween.

6. The vehicle assembly of claim 5, wherein the floor member and the engagement interface form a unitary piece.

7. The vehicle assembly of claim 1, wherein the engagement interface comprises a recess feature and the cover comprises a protrusion feature, the protrusion feature being engageable with the recess feature to couple the cover to the engagement interface.

8. The vehicle assembly of claim 1, wherein the receptor comprises a keyhole having a keyhole height, and wherein the aperture has an aperture height corresponding to the keyhole height.

9. The vehicle assembly of claim 1, wherein the engagement member is coupled to the interior surface of the cover.

10. An automotive vehicle assembly comprising:

a vehicle panel;

a physical engagement interface disposed on the panel;

a cover, removably coupled to the physical engagement interface, the cover having an interior surface, an exterior surface, and an aperture extending from the exterior surface through the interior surface;

a lift member coupled to the interior surface and arranged to, in response to insertion of a tool into the aperture, deflect the cover relative to the engagement interface;

an engagement member coupled to the interior surface;

a floor member coupled to the panel and spaced from the lift member to accommodate a tool inserted into the aperture therebetween; and a deflectable retaining member having a first end and a second end, the first end being coupled to the panel and the second end being disposed in register with the aperture, the retaining member being deflectable between a first position and a second position, wherein in the first position the retaining member engages the engagement member to retain the cover to the engagement interface and in the second position the retaining member does not engage the engagement member, and wherein the deflectable retaining member is configured to deflect from the first position to the second position in response to insertion of the tool into the aperture.

11. The automotive vehicle assembly of claim 10, wherein the vehicle panel includes an exterior body panel having a keyhole disposed thereon, the cover being positioned to inhibit access to the keyhole when coupled to the physical engagement interface.

* * * * *